United States Patent [19]

Maes

[11] 4,388,772

[45] Jun. 21, 1983

[54] ADJUSTABLE SIGHT FOR FIREARMS

[75] Inventor: Michel E. Maes, Bellevue, Wash.

[73] Assignee: Detonics Pistol Accessories, Ltd., Seattle, Wash.

[21] Appl. No.: 224,318

[22] Filed: Jan. 12, 1981

[51] Int. Cl.[3] ..... F41G 1/10

[52] U.S. Cl. ..... 42/1 S; 33/233

[58] Field of Search ..... 42/1 S; 33/233, 252, 33/254, 257

[56] References Cited

U.S. PATENT DOCUMENTS

| | | | |
|---|---|---|---|
| 496,051 | 4/1893 | Freund | 33/233 |
| 1,523,319 | 1/1925 | Vosmek | 42/1 S |
| 2,473,891 | 6/1949 | Lillard | 33/254 |
| 3,641,676 | 2/1972 | Knutsen et al. | 42/1 S |
| 3,646,682 | 3/1972 | Edwin | 42/1 S |

FOREIGN PATENT DOCUMENTS

| | | | |
|---|---|---|---|
| 412642 | 11/1966 | Switzerland | 42/1 S |

*Primary Examiner*—Charles T. Jordan

*Attorney, Agent, or Firm*—Seed, Berry, Vernon & Baynham

[57] ABSTRACT

An adjustable sight for firearms of the type having a trapezoidally shaped dovetail extending transversely across the upper rear end of the firearm and a sighting bead projecting upwardly at the front of the slide. The adjustable sight includes a trapezoidally shaped base which replaces trapezoidally shaped, fixed sights normally mounted in the dovetail. The base is frictionally secured to the slide by a set screw extending through a threaded bore in the base which is torqued against the lower wall of the dovetail. A transverse slot formed in the base receives a sight blade having formed therein a notch projecting downwardly from its upper edge. The blade is held in place by a blade set screw mounted in a second threaded bore in the base. The set screw intersects the slot at an acute angle, and its end is sufficiently pointed so that its lower surface contacts the lower edge of an aperture formed in the blade. The aperture is positioned at the side of the notch, which causes the notch to rotate downwardly as the set screw imparts a rotational moment to the blade about the aperture, thereby forcing the lower edge of the blade against the bottom of the slot. The aperture is elliptically shaped, with its major axis positioned vertically so that clearance is provided between the end of the set screw and the upper edges of the aperture and to ensure that the blade is centered in the slot. The elevation of the firearm is adjusted by sequentially mounting blades in the slot having varying heights until the vertical accuracy of the firearm is maximized. The windage of the firearm is adjusted by loosening the base set screw and shifting the base to either side until the windage accuracy is maximized.

5 Claims, 5 Drawing Figures

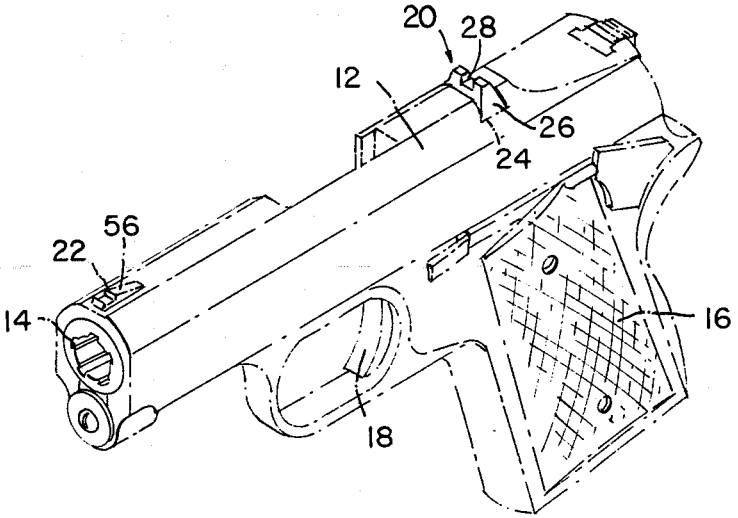
FIG. 1
FIG. 2
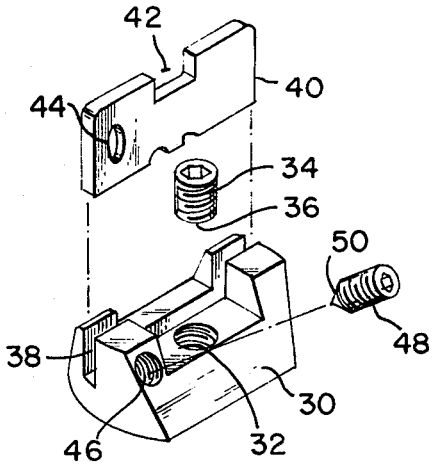
FIG. 3
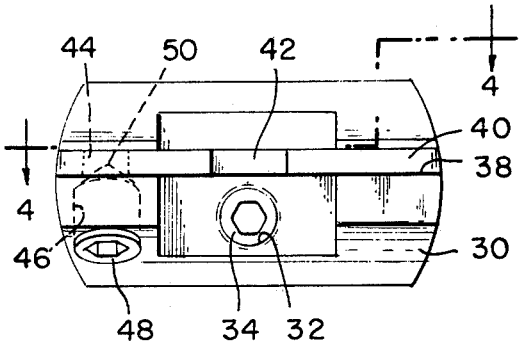
FIG. 4
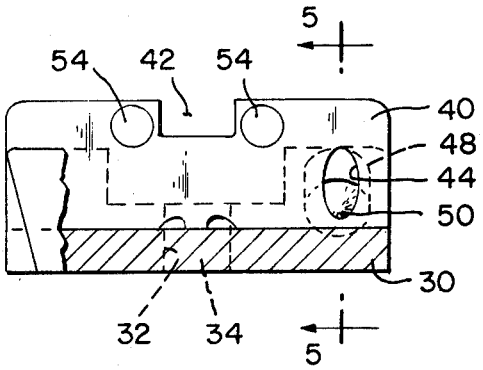
FIG. 5
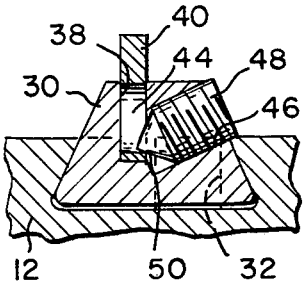

ADJUSTABLE SIGHT FOR FIREARMS

TECHNICAL FIELD

This invention relates to firearms, and more particularly, to an adjustable sight for firearms.

BACKGROUND ART

Firearms generally utilize a pair of front and rear sights mounted on a portion of the firearm, such as the slide of a semiautomatic firearm, which assist in aiming the firearm. The rear sight is essentially a notched pedestal having a trapezoidal shape which fits into a trapezoidal dovetail in the firearm. The front sight generally consists of a sight bead projecting upwardly which is aligned with the notch in the rear sight for aiming.

Conventional fixed sights, as described above, are suitable for most applications where extreme accuracy is not required. Even though firearms are machined with great accuracy, manufacturing tolerances nevertheless introduce some degree of inaccuracy so that the actual trajectory of the bullet does not coincide with the sight axis. Attempts have been made to correct this limitation and to compensate for wind effects by designing adjustable sights. Adjustable sights have also been designed to compensate for the effect of wind on the bullet's trajectory, to vary the aiming point depending upon the target's distance, and to vary the aiming point to compensate for variations in performance resulting from the use of different types of ammunition. All of these adjustable sights are relatively expensive, and they are somewhat fragile. Additionally, they are generally used with specially manufactured firearms and are thus not suitable for a wide retrofit market.

DISCLOSURE OF THE INVENTION

It is an object of the invention to provide an adjustable sight for firearms which provides the shooting accuracy of precision sights yet is manufactured with a minimum of precision machining.

It is another object of the invention to provide an adjustable sight which can be retrofitted onto a wide variety of firearms.

It is still another object of the invention to provide an adjustable sight for firearms which allows both the windage and elevation aiming characteristics to be adjusted.

It is a further object of the invention to provide an adjustable sight for firearms which may be installed and adjusted without the assistance of a skilled gunsmith.

These and other objects of the invention are provided by an adjustable sight having a base in which a slot is formed extending transversely across the upper rear surface of the firearm. A sight blade is releasably mounted in the slot so that it can be easily replaced. The blade has a notch extending downwardly from its upper edge at its approximate midpoint to allow the firearm to be aimed horizontally by aligning the notch with a sight bead projecting upwardly from an upper front surface of the firearm and vertically by aligning the upper edge of the blade with the top of the front sight. The elevation of the sight may be adjusted by mounting successive blades in the slot, each having a different height. The firearm is tested after each blade is mounted until the optimum accuracy is achieved. The base preferably has a generally trapezoidal cross-section so that it can be inserted in the trapezoidally shaped dovetails generally formed in conventional firearms. The windage of the sight may then be adjusted by shifting the base transversely in either direction until the optimum accuracy is achieved. A base set screw threaded into a through bore formed in the base is torqued against the firearm to frictionally secure the base within the dovetail. A blade set screw is threaded into a second through bore in the base which intersects the slot at an acute angle. An aperture formed in the blade is positioned at the point of intersection between the through bore and slot so that the blade may be held in place with the end of the screw projecting through the aperture. The aperture is preferably positioned to the side of the notch, which causes the notch to move downwardly as the blade rotates about the aperture in the direction in which the set screw rotates as it is torqued against the blade. Consequently, tightening the set screw causes the blade to move downwardly, with its lower edge contacting the bottom of the slot. The end of the blade-locking screw should be sufficiently pointed so that the screw contacts the lower edge of the aperture before contacting the upper edge so that the screw biases the blade downwardly against the bottom of the slot. Although the aperture may assume a variety of shapes, it is most desirably elliptically shaped with a vertical major axis to provide clearance between the screw and the upper edges of the aperture and to ensure that the screw is centered in the aperture. A pair of contrasting markers may be symmetrically positioned on opposite sides of the notch so that they may be aligned in a horizontal row with a similar marker on the front sight bead.

BRIEF DESCRIPTION OF THE DRAWINGS

FIG. 1 is an isometric view of a semiautomatic firearm utilizing a conventional fixed sight.

FIG. 2 is an exploded isometric view of a semiautomatic firearm utilizing the inventive adjustable sight.

FIG. 3 is a top plan view of the adjustable sight of FIG. 2.

FIG. 4 is a cross-sectional view taken along the line 4—4 of FIG. 3.

FIG. 5 is a cross-sectional view taken along the line 5—5 of FIG. 4.

BEST MODE FOR CARRYING OUT THE INVENTION

A conventional semiautomatic firearm, as illustrated in FIG. 1, includes a slide 12 housing a barrel 14 through which a bullet passes as the firearm is fired. A handle 16 projects downwardly from the slide 12, and a trigger assembly is positioned in front of the handle 16 beneath the slide 12. As is well known in the art, when the trigger 18 is actuated, a firing pin strikes the rear of a cartridge, thereby propelling a bullet from the barrel 14. The recoil forces of the bullet cause the slide 12 to move rearwardly against recoil springs to absorb the recoil forces while ejecting the spent cartridge and loading a fresh cartridge into an internal firing chamber.

The firearm 10 is used by aligning the slide 12 with a target to maximize its shooting accuracy. Aligning of the slide 12 with a target is greatly facilitated by aligning a rear sight 20 with a front sight 22. The rear sight 20 is generally trapezoidal in shape, and it fits a trapezoidally shaped dovetail 24 extending transversely across the slide 12. The sight 20 includes a pedestal 26 having formed therein a notch 28 projecting downwardly from the upper edge of the pedestal 26 at its midpoint.

The front sight 22 is basically a sight bead which projects upwardly from the upper surface of the slide 12. The sights 20,22 are used to aim the firearm horizontally by aligning the notch 28 with the front sight 22. The sights 20,22 are used to aim the firearm vertically by aligning the upper edge of the rear sight 20 with the top of the front sight 22. Positioning the front sight 22 to either side of the notch 28 causes the bullet to miss the target at the corresponding side. Positioning the front sight 22 above or below the upper surface of the rear sight 20 causes the bullet to vertically miss the target.

A conventional semiautomatic firearm, as illustrated in FIG. 1, is manufactured with a great deal of precision machining. Nevertheless, production tolerances preclude the notch 28 and front sight 22 from being exactly aligned with the bore of the barrel 14. Such inaccuracies are generally suitable for most circumstances, but where extreme accuracy is required, the mismatch between the barrel axis and the sighting axis is a serious limitation. Also, it is impossible for a fixed sight to accurately represent the actual trajectory of a bullet when different types of ammunition are used, the wind to which the bullet is exposed varies in intensity or direction, or the distance to the target varies.

The adjustable sight, as illustrated in FIGS. 2–5, includes a base 30 of generally trapezoidal cross-section which is adapted to fit into the dovetail 24 of a conventional firearm. The base 30 has formed therein a vertically extending through bore 32 which receives a set screw 34 having a fairly blunt lower end 36. The set screw 34 is torqued against the slide 12 to frictionally secure the base 30 within the dovetail 24.

The base 30 has formed therein a slot 38 extending the length of the base 30 so that it extends transversely across the slide when the base 30 is mounted in the slide 12. Although the slot 38 may assume a variety of configurations, it is most preferably of uniform width throughout. The slot 38 receives a sighting blade 40, preferably of uniform thickness, having a length corresponding to the length of the slot 38. A notch 42 is formed in the blade 40 at its midpoint. As explained in greater detail hereinafter, the height of the blade varies in order to adjust the elevation of the sight, and the depth to which the notch 42 projects downwardly from the upper edge of the blade 40 may vary depending upon the distance that the front sight 22 projects upwardly.

When the blade 40 is correctly positioned in the slot 38, an aperture 44 formed in the blade 40 is aligned with a through bore 46 in the base 30. The bore 46 receives a blade set screw 48 to secure the blade 40 within the slot 38. An important aspect of the adjustable sight is the use of a set screw 48 having an end 50 which is sufficiently pointed that the lower surface of the pointed end 50 contacts the lower edge of the aperture 44, as best illustrated in FIG. 5. Since the through bore 46 intersects the slot 38 at an acute angle, a relatively blunt end on the screw 48 would cause the upper surface of the screw to contact the upper edge of the aperture 44. This configuration would force the blade 40 upwardly so that the blade 40 would be tilted in the slot 38 in an unpredictable manner, thereby degrading the accuracy of the sight. In contrast, as best illustrated in FIG. 5, the end 50 of the screw 48, which is sufficiently pointed, causes the lower surface of the end 50 to contact the lower edge of the aperture 44, thereby forcing the blade 40 downwardly so that the lower edge contacts the bottom of the slot 38. In this configuration, the blade is in a known and readily repeatable position for uniformity and predictability of sighting accuracy.

Although the aperture 44 may assume a variety of shapes, it is most preferably elliptical in shape, with the major axis of the ellipse extending vertically. An elliptically shaped aperture 44 provides clearance between the end 50 of the blade set screw 48 and the upper edges of the aperture 44 to ensure that the screw 48 does not lift the lower edge of the blade 40 above the bottom of the slot 38. Additionally, an elliptically shaped aperture 44 ensures that the screw 48 is centered in the aperture 44 so that the transverse position of the notch 42 will remain constant as the blade 40 is removed and reinstalled.

Another important feature of the adjustable sight is the positioning of the aperture 44 to the side of the notch 42, which causes a moment generated about the aperture 44 to move the notch 42 downwardly as the screw 48 is torqued against the blade 40. As best illustrated in FIG. 4, clockwise rotation of the blade set screw 48 applies a clockwise moment to the blade 40 about the aperture 44. The clockwise moment tends to move the notch 42 downwardly, thereby maintaining contact between the lower edge of the blade 40 and the bottom of the slot 38. In contrast, counterclockwise moment about aperture 44 would tend to move the notch 42 upwardly, thereby lifting the lower edge of blade 40 from the bottom of the slot 38. The blade 40 would then assume an unpredictable position, thereby degrading the accuracy of the sight.

Contact between the lower edge of the blade 40 and the bottom of the slot 38 could also be maintained by utilizing an aperture 44 and blade set screw 48 on each side of the notch 42. However, this structure would materially increase the precision required to manufacture the sight since the position of the second aperture with respect to both the first aperture 44 and the notch 42 would have to be precisely controlled. Also, the position of the bore 46 in base 30 with respect to a second bore would have to be precisely controlled. In contrast, the position of the single aperture 44 need be precisely controlled only with respect to the notch 42.

Although an adjustable sight could be implemented by successively mounting fixed sights in the dovetail 24, each having a notch 28 of a different depth, the sight would be substantially more expensive than the inventive sight since the major expense of the sight is the portion that fits into the dovetail 24. The inventive sight instead uses a single relatively expensive base 30 and several substantially less expensive blades 40.

As a matter of personal preference, to improve the sighting accuracy for some individuals, a pair of contrasting markers 54 may be symmetrically positioned on opposite sides of the notch 42. A similar marker 56 (FIG. 1) is placed on the front sight 22 so that when the front sight 22 is vertically positioned in the notch 42, all three markers 54,56 are aligned in a horizontal row.

The sight is normally purchased with a single base 30 and several blades 40, each having a different height. The correct blade 40 is determined by installing a blade 40 having a height at one end of the range and testing the accuracy of the firearm. Different blades 40, having successively increasing or decreasing heights, are then sequentially installed until the optimum accuracy is obtained. The windage or horizontal accuracy of the sight is adjusted by slightly loosening the base set screw 34 and sliding the base 30 transversely in either direction until the optimum accuracy is obtained.

Although the adjustable sight is illustrated herein for use with a semiautomatic firearm, it will be understood that it may also be used with any firearm normally using aiming sights, including, for example, revolvers, rifles and shotguns. Also, although the base 30 is shown slidably mounted in a transverse dovetail 24, it will be understood that the base 30 may be integrally formed with the firearm.

The inventive sight thus allows the accuracy of conventional semiautomatic firearms to be optimized. Furthermore, the sight is relatively inexpensive because its structure inherently eliminates the need for precisely machined components.

I claim:

1. An adjustable sight for firearms, comprising:

a base having a slot extending transversely across an upper rear surface of said firearm; and a sight blade releasably mounted in said slot, said blade having a notch extending downwardly at the approximate midpoint of said blade to allow said firearm to be aimed by aligning said notch with a sight bead projecting upwardly from an upper front surface of said firearm whereby the sighting characteristics of said firearm may be altered by substituting sight blades having varying heights, said sight further including a threaded bore formed in said base extending downwardly from an upper surface thereof to intersect said slot at an acute angle, an aperture formed in said blade at the point of intersection between said bore and said slot, and a blade set screw threaded into said bore, said set screw having an end which is sufficiently pointed that the lower surface of said point contacts the lower edge of said aperture, thereby urging the lower surface of said blade against the bottom of said slot.

2. The sight of claim 1 wherein said aperture is on the side of said notch, which causes said notch to move downwardly responsive to moments imparted to said blade about said aperture by said blade set screw as it is torqued against said blade in order to ensure that said blade abuts the lower edge of said slot.

3. The sight of claim 1 wherein said aperture is substantially in the shape of an ellipse having a vertical major axis to provide clearance between the end of the said blade set screw and the upper edge of said aperture and to automatically center said blade set screw in said aperture.

4. An adjustable sight for a firearm of the type having a transversely extending, trapezoidally shaped dovetail formed in the upper surface of said firearm near the rear end thereof adapted to receive a trapezoidally shaped fixed sight, and a sight bead projecting upwardly from the upper surface of said firearm near the front end thereof, said sight comprising:

a trapezoidally shaped base adapted for insertion in the trapezoidally shaped dovetail, said base having a slot formed therein extending transversely across said firearm when said base is inserted in said dovetail, said base further including a first threaded through bore extending from an upper surface of said base to a surface of said base which normally contacts the walls of said dovetail and a second threaded through bore extending from an upper surface of said base to intersect said slot at an acute angle;

a sight blade of a uniform thickness inserted in said slot, said blade having a notch projecting downwardly from the upper edge thereof at the approximate midpoint of said blade, said blade further having formed therein an aperture positioned at one side of said notch and at a location adjacent said second through bore when said notch is at the approximate midpoint of said slot;

a base set screw threaded into said first through bore and torqued against a wall of said dovetail to frictionally secure said base within said dovetail; and a blade set screw threaded into said second through bore, said screw having an end which is sufficiently pointed that the lower surface of said point contacts the lower edge of said aperture, thereby urging the lower surface of said blade against the bottom of said slot.

5. The sight of claim 4 wherein said aperture is substantially in the shape of an ellipse having a vertical major axis to provide clearance between the end of said blade set screw and the upper edges of said aperture and to center said blade set screw in said aperture, said aperture being located on the side of said notch, which causes said notch to move downwardly responsive to a rotational moment applied to said blade about said aperture by said blade set screw as it is torqued against said blade in order to ensure that said blade abuts the lower edge of said slot.

* * * * *